US005181318A

United States Patent [19]

Janota et al.

[11] Patent Number: 5,181,318

[45] Date of Patent: Jan. 26, 1993

[54] METHOD OF ASSEMBLING AN ELECTRICAL CONNECTOR

[75] Inventors: Kenneth F. Janota, Lisle; Michael J. Miskin, Naperville, both of Ill.

[73] Assignee: Molex Incorporated, Lisle, Ill.

[21] Appl. No.: 818,447

[22] Filed: Dec. 30, 1991

Related U.S. Application Data

[62] Division of Ser. No. 681,211, Apr. 5, 1991, Pat. No. 5,102,350.

[51] Int. Cl.[5] ..... H01R 43/04

[52] U.S. Cl. ..... 29/882; 29/876; 361/424

[58] Field of Search ..... 361/424; 29/832, 834, 29/882, 741, 876

[56] References Cited

U.S. PATENT DOCUMENTS 4,906,201 3/1990 Young et al. ..... 29/832 X

*Primary Examiner*—Carl J. Arbes

*Attorney, Agent, or Firm*—A. A. Tirva

[57] ABSTRACT

An electrical connector is provided for mounting to a substrate such as a printed circuit board or the like. The connector includes an insulative housing having a top, opposite sides and a base portion which is mountable to the printed circuit board. A conductive shield is positionable about at least a portion of the housing. A unitary conductive ground strap is mounted on the housing in engagement with the shield and includes a pair of legs depending along the opposite sides of the housing. The legs have tail portions at the distal ends thereof projecting beyond the base portion of the housing for insertion into holes in the printed circuit board to ground the shield to appropriate ground traces on the board.

4 Claims, 1 Drawing Sheet

FIG.1
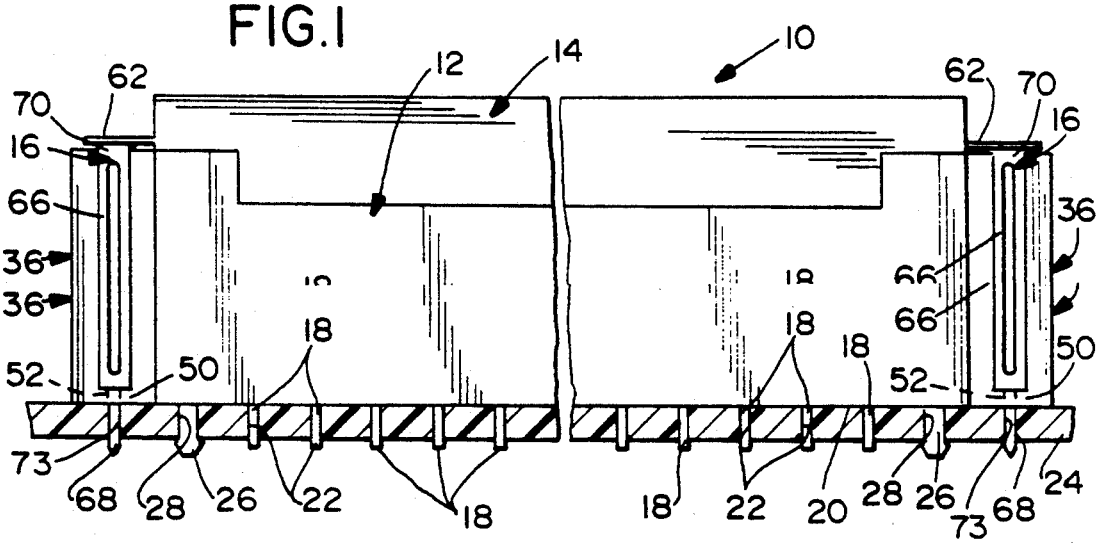
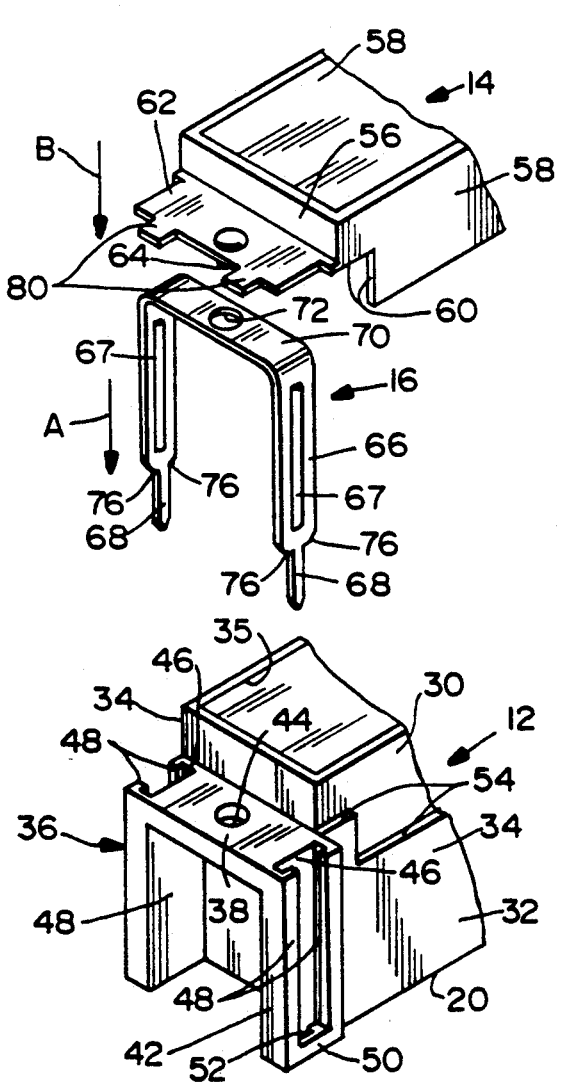
FIG.2

METHOD OF ASSEMBLING AN ELECTRICAL CONNECTOR

This is a division of application Ser. No. 07/681,211 filed on Apr. 5, 1991, now U.S. Pat. No. 5,102,350 issued Apr. 7, 1992.

FIELD OF THE INVENTION

This invention generally relates to the art of electrical connectors and, particularly, to an electrical connector mountable to a substrate such as a printed circuit board, or the like, for grounding thereto.

BACKGROUND OF THE INVENTION

In the electronics industry, electrical connectors are often mounted to printed circuit boards for electrical connection to circuit traces on the boards. Typically, the electrical connectors are positioned on the printed circuit boards by automated methods, and the electrical connections are wave soldered to the circuits on the boards. The connectors usually include some form of locking or retention feature to hold the connectors to the boards and, in the case of shielded connectors, the connectors include a commoning means coupled to ground traces on the board, often by insertion of at least one commoning element through a hole of the printed circuit board.

One type of electrical connector assembly of the character described above is known in the electrical connector assembly industry as a miniature or subminiature D connector. The connector includes a plug and a receptacle, each having an insulative housing containing a plurality of mating terminals or contacts. In order to shield against RF/EM interference, an exterior metal or conductive shell typically encloses each housing. The shielding shells are effectively grounded to the ground traces on the printed circuit board.

One of the main problems in utilizing such miniature connectors in conjunction with printed circuit boards is the cost of assembling the connectors themselves which is done prior to assembling the connectors to the printed circuit boards. Often, extraneous locking hardware, such as bolts, posts and rivets are used both to assemble the connectors and ready the connectors for interconnection to the boards. Although automated processes are being used to interconnect the connectors to the printed circuit boards, automated processes for assembling the connectors themselves have been difficult because of the nature of the miniature connector construction in combination with the extraneous hardware used in the connector assembly. Often, the connector components are assembled in directions on given axes, such as assembling the shielding shell to the housing in one direction on a given axis, and the extraneous hardware is assembled in different directions on other axes, requiring multiple tooling stages and/or different assembly stations in the assembly process.

This invention is directed to solving the above problems and providing a new and improved shielded electrical connector adapted for mounting on a printed circuit board, which substantially entirely eliminates extraneous assembly, locking, and mounting hardware required for connecting the connector shield to ground traces on a printed circuit board and Which is readily adaptable for automated assembly processes.

SUMMARY OF THE INVENTION

An object, therefore, of the invention is to provide a new electrical connector for mounting to a substrate such as a printed circuit board for grounding thereto.

Generally, the electrical connector includes an insulative housing mounting a plurality of terminals, a conductive shield and a conductive ground strap member. These three components, alone, substantially entirely make up the connector for assembly to the printed circuit board. The insulative housing has a top portion, opposite sides and a base portion which is mountable to the printed circuit board. A conductive shield is positionable about at least a portion of the housing, particularly the top portion thereof. A conductive ground strap is mounted on the housing in engagement with the shield and includes a pair of legs depending along the opposite sides of the housing. Tail portions at the distal ends of the legs project beyond the base portion of the housing for insertion into holes in the printed circuit board to ground the shield to appropriate ground traces on the board.

In the exemplary embodiment of the invention, the conductive ground strap is generally U-shaped, defining the legs of the strap and including a bight portion of the strap spanning proximal ends of the legs. The bight portion overlies a top surface of the housing. The conductive shield includes a portion overlying the bight portion of the U-shaped ground strap, sandwiching the bight portion between the shield and the housing. The housing includes recess means between the bight portion; the bight portion includes an aperture in registry with the recess means; and the conductive shield includes an integral strap retaining boss extending through the aperture into the recess means.

It can be seen from the above description that the conductive shield and the U-shaped conductive ground strap can be assembled to the insulative housing in a singular direction downwardly onto the top of the housing, whereby the tail portions at the distal ends of the legs of the ground strap project from the bottom of the housing for insertion into holes in the printed circuit board.

Other features of the invention include providing the housing with slots in the opposite sides thereof within which the legs of the ground strap are disposed. The slots are generally keyhole shaped in cross-section to define side flanges for capturing the legs in the slots. The housing includes solid portions at the bases of the slots, with holes in the solid portions through which the tail portions at the distal ends of the legs project.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a side elevational view of an elongated electrical connector embodying the concepts of the invention; and FIG. 2 is a fragmented exploded perspective view of the left-hand end of the connector of FIG. 1, illustrating an exploded depiction of the three basic components of the connector.

DETAILED DESCRIPTION OF THE PREFERRED EMBODIMENT

Referring to the drawings in greater detail, and first to FIG. 1, the invention is illustrated as embodied in a miniature connector, generally designated 10, which includes three basic components, namely: an insulative housing, generally designated 12, a conductive shield, generally designated 14, and at least one conductive ground strap, generally designated 16. In the embodiment of the invention shown herein, two conductive ground straps 16 are utilized, one ground strap at each opposite end of the connector.

Electrical connector 10 may be of a variety of configurations, including a miniature or sub-miniature D connector. Regardless of the configuration, the connector will include a plurality of terminals 18 appropriately mounted within housing 12, with the terminals projecting from a bottom surface 20 of the housing in a direction generally parallel to axes of legs 66 of ground straps 16 for insertion into appropriate holes 22 in a substrate such as a printed circuit board 24 or the like. The terminals are electrically connected to appropriate circuit traces on the printed circuit board or in the holes thereof, all of which is known in the art. Housing 12 also may include integral board lock posts 26 projecting through appropriate holes 28 in the printed circuit board to lock the connector to the board prior to soldering terminals 18.

Referring to FIG. 2 in conjunction with FIG. 1, insulative housing 12 has a top portion 30, a base portion 32 defining surface 20 (FIG. 1) which is mountable to the printed circuit board, and opposite sides 34. A mating plug, not shown can be inserted into cavity 35 as is known in the art. The housing is unitarily molded of dielectric material, such as plastic or the like, and includes end sections, generally designated 36, which have generally inverted U-shaped configurations. Each end section 36 includes a top wall 38 defining a top surface 40, and side walls 42 forming extensions of sides 34 of the housing. For purposes described hereinafter, top surface 40 has recess means in the form of a hole 44 through top wall 38. Also for purposes described in greater detail hereinafter, side walls 42 have slots 46 extending vertically thereof. The slots are generally keyhole shaped to define flanges 48 partially enclosing the slots. Solid portions 50 of the unitary housing close the bases of slots 46, and holes 52 are provided through solid portions 50. Lastly, opposite sides 34 of housing 12 have stepped configurations, as at 54, to offset top portion 30 from bottom portion 32.

Conductive shield 14 is generally rectangularly shaped and substantially hollow in order to embrace top portion 30 of housing 12. The shield is stamped and formed in one piece of sheet metal material. The shield includes opposite end walls 56 and opposite side walls 58. It can be seen that the side walls have stepped configurations at the ends thereof, as at 60, for mating into the stepped configurations 54 of opposite sides 34 of housing 12 The shield also has a flange 62 projecting outwardly from the bottom edge of each end wall 54. This flange overlies top surface 40 of housing 12 and has tabs 80 extending from it which tabs are bent around the wall 38 to attach shield 14 to the housing 12. Lastly, an integral strap retaining boss 64 depends from the underside of each flange 62.

Each conductive ground strap 16 is in the general shape of an inverted U defining a pair of legs 66 with tail portions 68 at the distal ends of the legs. Each ground strap is stamped and formed in one piece from sheet metal material. The proximal ends of legs 66 are joined by a bight portion 70 of the inverted U-shaped strap. An aperture 72 is formed generally centrally of bight portion 70. Legs 66 include stamped raised and elongated dimples 67 to provide additional rigidity. Tail portions 68 are inserted through holes 73 (FIG. 1) in the printed circuit board for connection to appropriate ground traces on the board (not shown).

In case the shielded connector is mounted utilizing the surface mount technology e.g. there may not be openings 73 in the board, the ends of tail portions 68 may be bent substantially orthogonal to the vertical axis of legs 66 in such that the bent portions will make contact with appropriate ground traces on the board.

With the above description of insulative housing 12, conductive shield 14 and conductive ground straps 16, reference is made particularly to FIG. 2 for explaining the simple assembly operation of electrical connector 10. In the following description, reference will be made to only one of the ground straps, since only one strap is depicted in FIG. 2. More particularly, ground strap(s) 16 is assembled to housing 12 in the direction of arrow "A" by inserting legs 66 into the top of slots 46 and moving the ground strap in direction "A" until tail portions 68 project through holes 52 in solid portions 50. Flanges 48 of the keyhole shaped slots 46 capture legs 66 securely within the slots. When so positioned, aperture 72 in bight portion 70 of the conductive strap is aligned with hole 44 in top wall 38 of end section 36 of the housing 12.

Conductive shield 14 is assembled in the direction of arrow "B" (FIG. 2), which is parallel to direction "A", by sliding the shield over top portion 30 of housing 12. When so assembled, flange 62 of the shield sandwiches bight portion 70 of ground strap 16 between the flange and top wall 38 of the housing. Boss 64, being formed integral with shield 14, projects through aperture 72 in bight portion 70 of the strap, and the boss is of sufficient length to project into hole 44 in wall 38 of the housing. The conductive ground strap thereby is held very securely to insulative housing 12 in conductive engagement with conductive shield 14 by the positioning of the legs of the ground strap in the slots of the housing, with the bight portion of the ground strap in full engagement with flange 62 of the conductive shield, and further with boss 64 extending through aperture 72 in the ground strap. It can be seen that a commoning ground is established from conductive shield 14 through ground straps 16 to ground traces of the printed circuit board Without the use of any extraneous locking hardware whatsoever, such as bolts, rivets, separate posts and the like. In addition, the ease of assembly of the major components of the connector is readily apparent by reference to FIG. 2 wherein it can be seen that the ground straps and the conductive shield are assembled to the housing in a singular direction as represented by arrows "A" and "B". The assembly operation, in fact, can be carried out by a singularly directed press application tool.

In an alternate method of assembly the ground straps 16 are first assembled to the shield 14 by riveting, welding or the like and then the combination of shield 14 with the ground straps 16 attached is mounted onto the housing 12. Additionally, slots 48 in the housing may be made to extend all the way through eliminating solid portions 50 and the openings 52.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A method of assembling an electrical connector for mounting to a substrate such as a printed circuit board, comprising the steps of:

providing an insulative housing having a top, opposite sides and a base portion which is mountable to the printed circuit board:

providing a conductive shield positionable about at least a portion of the housing;

providing a generally U-shaped ground strap having a bight portion spanning proximal ends of a pair of leg portions, the leg portions being configured for depending along opposite sides of the housing with tail portions at distal ends of the legs for projecting beyond the base portion of the housing into holes in the printed circuit board to ground the shield to appropriate ground traces on the board;

positioning the U-shaped ground strap onto the housing with the bight portion of the strap overlying a top surface of the housing and the legs of the ground strap depending along opposite sides of the housing; and positioning the conductive shield onto the top of the housing in engagement with the ground strap to sandwich a portion of the ground strap between a portion of the shield and the housing.

2. A method of assembling an electrical connector for mounting to a substrate such as a printed circuit board, comprising the steps of:

providing an insulative housing having a top, opposite sides and a base portion which is mountable to the printed circuit board;

providing a conductive shield positionable about at least a portion of the housing;

providing a generally U-shaped ground strap having a bight portion spanning proximal ends of a pair of leg portions, the leg portions being configured for depending along opposite sides of the housing with tail portions at distal ends of the legs for projecting beyond the base portion of the housing into holes in the printed circuit board to ground the shield to appropriate ground traces on the board;

attaching the U-shaped ground strap onto the conductive shield; and positioning the U-shaped ground strap onto the housing with the bight portion of the strap overlying a top surface of the housing and the legs of the ground strap depending along opposite sides of the housing.

3. A method of assembling an electrical connector for mounting to a substrate such as a printed circuit board, comprising the steps of:

providing an insulative housing having a top, opposite sides and a base portion which is mountable to the printed circuit board;

providing a conductive shield positionable about at least a portion of the housing;

providing a generally U-shaped ground strap having a bight portion spanning proximal ends of a pair of leg portions, the leg portions being configured for depending along opposite sides of the housing with tail portions at distal ends of the legs for projecting beyond the base portion of the housing.

bending each tail portion substantially orthogonal to the vertical axis of each respective leg portion enabling the tail portions to contact ground traces on the board to ground the shield;

positioning the U-shaped ground strap onto the housing with the bight portion of the strap overlying a top surface of the housing and the legs of the ground strap depending along opposite sides of the housing; and positioning the conductive shield onto the top of the housing in engagement with the ground strap to sandwich a portion of the ground strap between a portion of the shield and the housing.

4. A method of assembling an electrical connector for mounting to a substrate such as a printed circuit board, comprising the steps of:

providing an insulative housing having a top, opposite sides and a base portion which is mountable to the printed circuit board;

providing a conductive shield positionable about at least a portion of the housing;

providing a generally U-shaped ground strap having a bight portion spanning proximal ends of a pair of leg portions, the leg portions being configured for depending along opposite sides of the housing with tail portions at distal ends of the legs for projecting beyond the base portion of the housing.

bending each tail portion substantially orthogonal to the vertical axis of each respective leg portion enabling the tail portions to contact ground traces on the board to ground the shield;

attaching the U-shaped ground strap onto the conductive shield; and positioning the U-shaped ground strap onto the housing with the bight portion of the strap overlying a top surface of the housing and the legs of the ground strap depending along opposite sides of the housing.

* * * * *